US006637350B2

(12) United States Patent
McKsymick

(10) Patent No.: US 6,637,350 B2
(45) Date of Patent: Oct. 28, 2003

(54) PORTABLE, COMPACT COMPUTER AND PROJECTOR STAND

(76) Inventor: Mark McKsymick, 16506 Centerpointe Dr., Grover, MO (US) 63040-1608

( * ) Notice: Subject to any disclaimer, the term of this patent is extended or adjusted under 35 U.S.C. 154(b) by 89 days.

(21) Appl. No.: 09/977,750

(22) Filed: Oct. 15, 2001

(65) Prior Publication Data

US 2002/0020655 A1 Feb. 21, 2002

Related U.S. Application Data

(63) Continuation-in-part of application No. 09/345,155, filed on Jun. 29, 1999, now Pat. No. 6,311,944, which is a continuation-in-part of application No. 09/111,223, filed on Jul. 7, 1998, now abandoned, which is a continuation-in-part of application No. 08/846,568, filed on Apr. 30, 1997, now abandoned.

(51) Int. Cl.[7] ..... A47B 85/00
(52) U.S. Cl. ..... 108/25; 108/90
(58) Field of Search ..... 108/25, 143, 90, 108/41, 43, 33, 144.11, 147.19; 248/161, 411, 157, 188.2, 188.5

(56) References Cited

U.S. PATENT DOCUMENTS 2,751,271 A * 6/1956 Dessertenne et al.
3,208,409 A * 9/1965 Gale
3,246,611 A * 4/1966 Benlian
4,034,518 A * 7/1977 Trecker
4,191,111 A * 3/1980 Emmert
4,565,403 A * 1/1986 Brown
4,856,627 A * 8/1989 Polatov
5,479,866 A * 1/1996 Rae
5,556,181 A * 9/1996 Bertrand
6,032,590 A * 3/2000 Chen
6,311,944 B1 * 11/2001 McKsymick et al.

FOREIGN PATENT DOCUMENTS

EP 0578744 A1 * 7/1992

* cited by examiner

*Primary Examiner*—Jose V. Chen
(74) *Attorney, Agent, or Firm*—John D. Gugliotta; P. Jeff Martin

(57) ABSTRACT

A portable, compact computer and projector stand is provided. A table top having a generally planar upper surface for supporting a laptop computer and a projector includes an L-shaped track receiving lip for engaging a linearly elongated channel formed within a table bottom for providing a linearly extendible table surface area. The table bottom is supported by removably attachable, hollow, telescopic legs and includes a lower surface forming an accessory insert receiving cavity for removably securing a foam insert which acts as a storage volume for telescoping legs and other accessories. A removably attachable, telescopic working document holder is provided for supporting documents, notes, sketches, and similar items.

17 Claims, 6 Drawing Sheets

PORTABLE, COMPACT COMPUTER AND PROJECTOR STAND

RELATED APPLICATIONS

The present invention is a Continuation in Part of Ser. No. 09/345,155, now U.S. Pat. No. 6,311,944 filed on Jun. 29, 1999, which was a Continuation in Part of Ser. No. 09/111,223, filed on Jul. 7, 1998, now abandoned which in turn was a Continuation in Part of Ser. No. 08/846,568, filed on Apr. 30, 1997, now abandoned.

BACKGROUND OF THE INVENTION

1. Field of the Invention

The present invention relates generally to a portable table for holding various objects. More particularly, the invention relates to a portable, compact computer and projector stand for supporting laptop computers, projectors, and associated components.

2. Description of the Related Art

In recent years the laptop portable personal computer, or simply "laptop" to which it is generally referred, has become an increasingly popular tool used by executives, salespersons, engineers, students, accountants, teachers, homemakers, lawyers and other business and professional persons. The laptop is very compact and was designed to rest in the user's lap so that the user has a "built-in" place for supporting the laptop when the user is seated. While this "built-in" supporting spot is convenient, it has many drawbacks. For one, the user's legs must be held still in order to keep the laptop from moving around. This is uncomfortable and can be a tiring exercise. Additionally, the user must have good balance to maintain the laptop in a position which can be particularly difficult when the user is using the laptop in conjunction with reading notes, books or other materials, as is often the case.

Other stands have been disclosed such as the one described by U.S. Pat. No. 5,054,736 which provides a laptop reading and writing stand, yet it suffers from the same problems connected with laptop computers because it rests on the lap of the user. Additionally, stands for computers are disclosed in U.S. Pat. Nos. 5,100,098 and 5,357,873; however, since neither of these patents specifically deal with laptops neither solves the above-described problems associated with laptop computers.

Workstations have been designed for laptops as shown in U.S. Pat. Nos. 4,830,328, 5,379,893, 5,445,266 and 5,470,041 which generally disclose workstations for supporting a laptop on a permanent desktop or table located in a business or residential environment. U.S. Pat. No. 4,830,328 also discloses the attachment of a pipe flange or straight coupling to the first plate to allow mounting to a tripod.

Consequently, a need has been felt for providing a portable, compact computer and projector stand having an adjustable height for supporting laptop computers, projectors, and associated components.

SUMMARY OF THE INVENTION

Briefly described according to one embodiment of the present invention, a portable, compact computer and projector stand is provided for supporting laptop computers 120, projectors 122, and associated components. The present invention comprises a generally planar table top designed to slidably a generally planar table bottom. A plurality of linearly elongated channels integrally formed along the table bottom serve as a track guide for slidably receiving an L-shaped track receiving lip of the table top. The channels have a plurality of spring-loaded detents aligned at spaced locations along a linear length therein for allowing selective linear adjustment of the table top. A medium density, closed cell foam insert is provided and is dimensionally-shaped so as to correspondingly rest in a fitting and snug manner within the accessory insert receiving cavity formed within the lower surface of the table bottom. The foam insert serves as a storage volume for telescoping legs and other accessories. The telescoping legs are each comprised of three leg members of decreasing diameter and are removably secured within a pocket of the table bottom via a plastic collet.

A removably attachable, telescoping working document holder is provided for being removably secured within an impingement void formed along a primary top of the upper surface of the table bottom. The document holder is comprised of an easel portion telescoping inside a pedestal and is suitable for supporting notes, documents, sketches, and the like.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
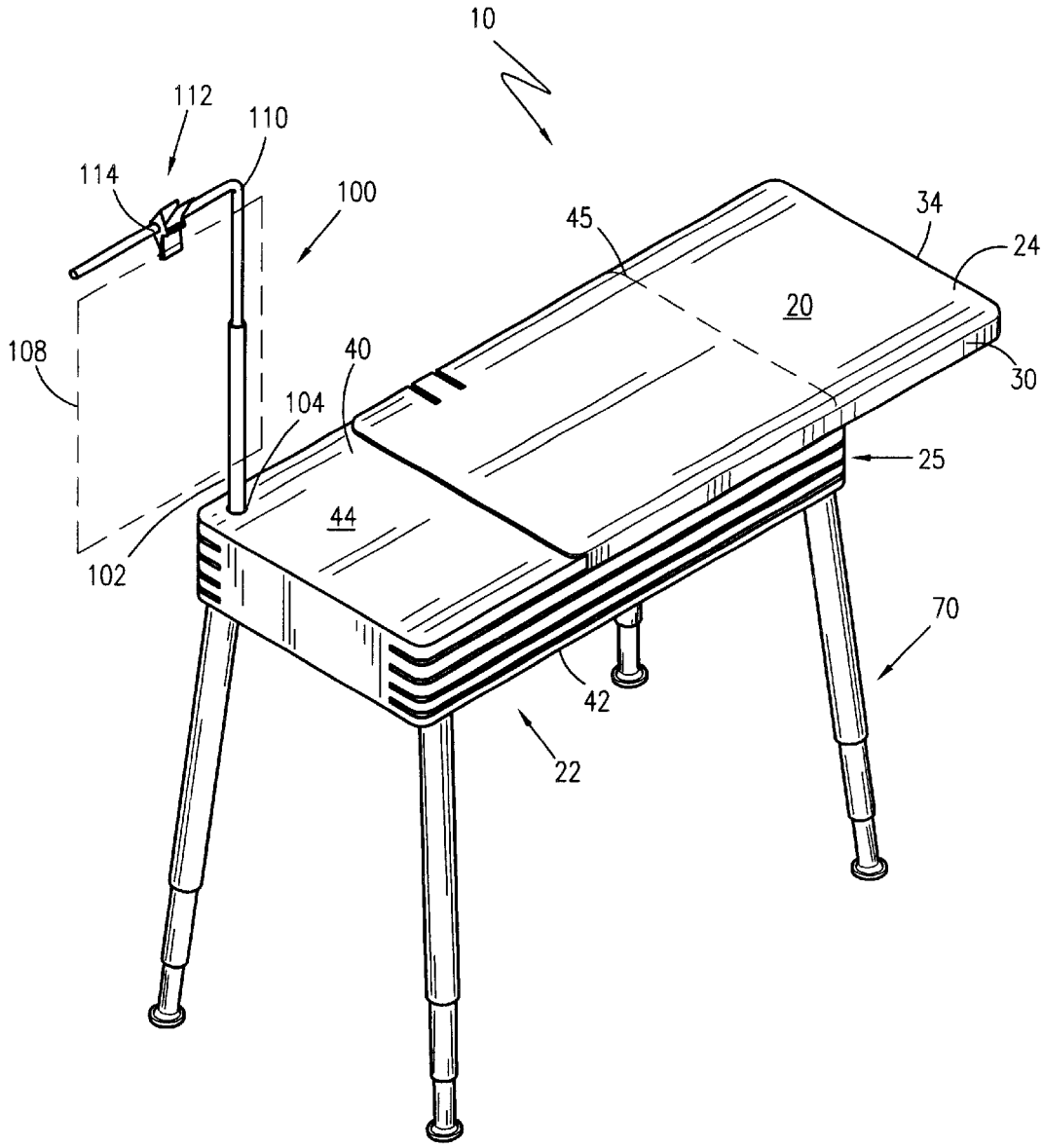
FIG. 1 is a perspective view of a portable, compact computer and projector stand according to the preferred embodiment of the present invention.
Figure 2:
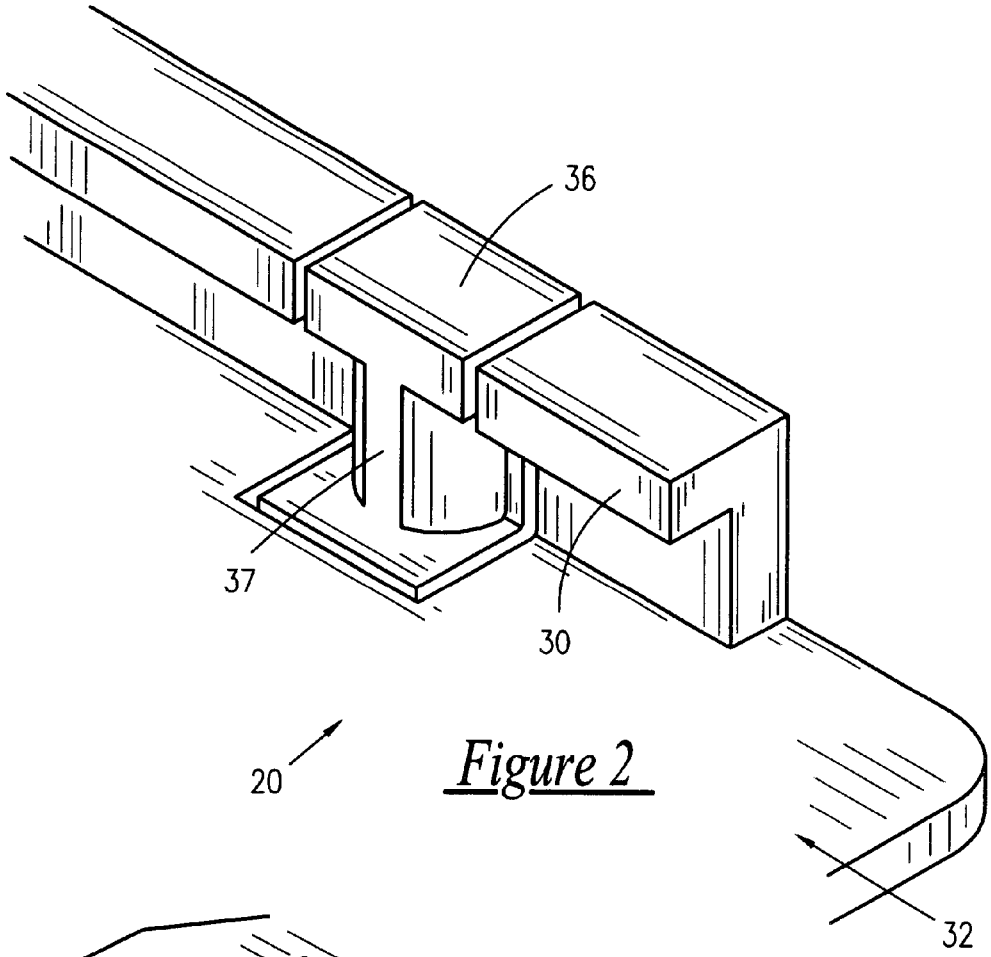
FIG. 2 is a perspective view of the lower surface of the table top illustrating the table bottom receiving end and the release/catch element according to the preferred embodiment of the present invention.

Referring now to FIGS. 1–3, and 10, a portable, compact computer and projector stand 10 is shown, according to the present invention, comprised of a generally planar table top 20 designed to slidably engage a generally planar table bottom 22. The table top 20 is constructed of a rigid plastic material and is defined as having a table bottom receiving end 32 opposite an enclosed end 34. The table top 20 is further defined as having an L-shaped track receiving lip 30 circumscribing a substantial portion of an upper surface 24 thereof and extending perpendicularly downward, the function of which to be described in greater detail below.

Referring now to FIGS. 2–5, the table bottom 22 is constructed of a rigid plastic material and is defined as having an upper surface 40 opposite a lower surface 42. The upper surface 40 is of a split-level design comprising a primary top 44 and a secondary top 45. Integrally formed and extending perpendicularly downward along opposite sides 25, 26 of the table bottom 22 are a plurality of linearly elongated channels 28 comprising an uppermost channel 28*a* which serves as a track guide for slidably receiving the L-shaped track receiving lip 30 of the table top 20. The uppermost channel 28*a* has a plurality of spring-loaded detents 38 aligned at spaced locations along a linear length therein. Upon linear engagement of the L-shaped track receiving lip 30 with the uppermost channel 28*a*, the table bottom receiving end 32 meets the top 44 of the table bottom 22 in a substantially flush manner, thereby forming a flat planar upper surface as shown in FIG. 1. The spring-loaded detents 38 allow for selective linear adjustment of the table top 20.

A flexible release/catch element 36 is molded integral to the upper surface 24 of the table top 20, and is comprised of a protruding catch projection 37 whose function will be better described below.

Selective linear adjustment of the table top 20 is accomplished via frictional engagement between the protruding catch projection 37 and each spring-loaded detent 38, whereby the spring-loaded detent 38 mechanically interferes with the protruding catch projection 37. Moderate longitudinal force applied by a user to the table top 20 serves to overcome such mechanical interference, thus allowing the table top 20 to proceed in a linear direction with respect to the table bottom 22.

Figure 3:
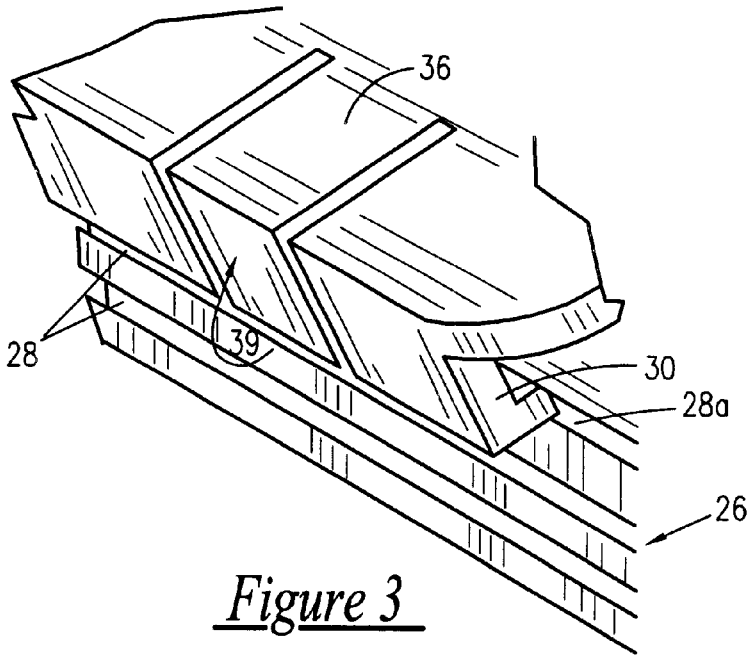
FIG. 3 is a partial elevated side view of the channels of the table bottom and the track receiving lip of the table top engaged therewith according to the preferred embodiment of the present invention.
Figure 4:
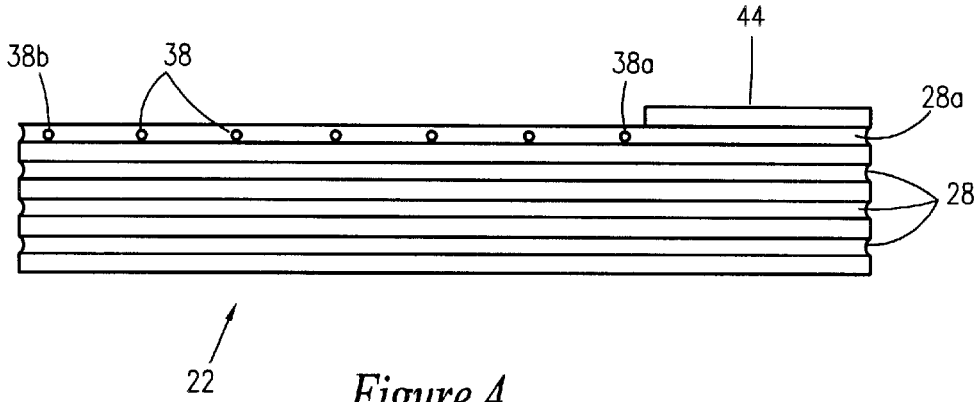
FIG. 4 is an elevated side view of the table bottom showing the detents and split-level design thereof according to the preferred embodiment of the present invention.
Figure 5:
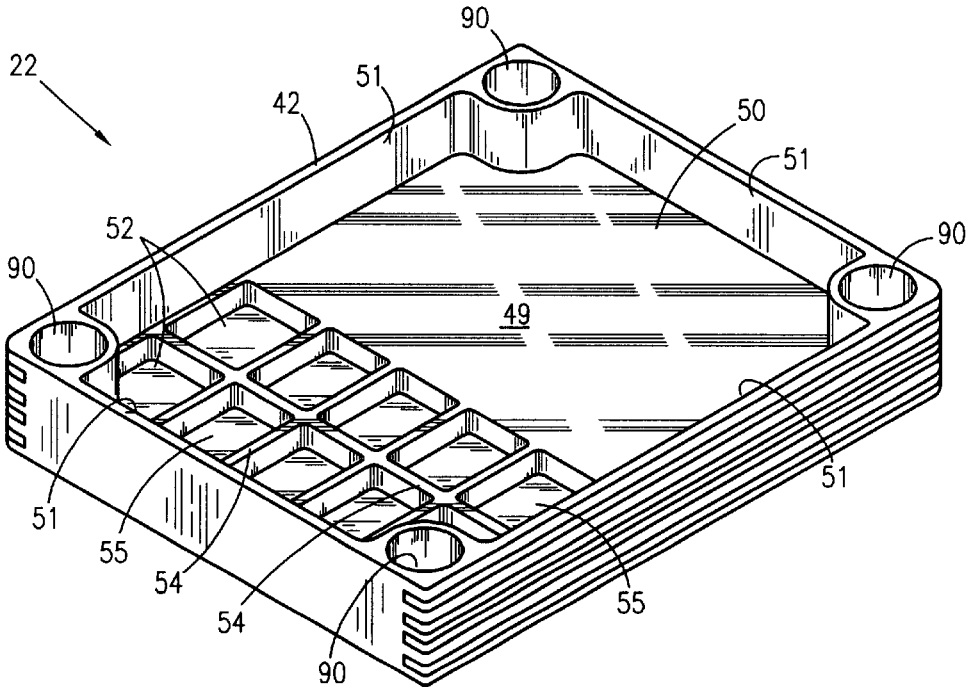
FIG. 5 is a perspective view of the lower surface of the table bottom revealing the accessory insert receiving cavity according to the preferred embodiment of the present invention.

Alternatively, a user may bypass any mechanical interference between the spring-loaded detents 38 and the protruding catch projection 37 by gently pulling on the flexible release/catch element 36 in a direction indicated by direction arrow 39 shown in FIG. 3. Subsequent release of the flexible release/catch element 36 allows for frictional engagement thereof with the nearest spring-loaded detent 38.

A proximal spring-loaded detent 38*a* is mountably positioned within the uppermost channel 28*a* in such a manner and location such that upon flush engagement by the table bottom receiving end 32 with the top 44 of the table bottom 22, the protruding catch projection 37 mechanically interferes with such spring-loaded detent 38*a*, thereby releasably uniting the table bottom receiving end 32 to the top 44 in a secure manner so as to form a flat planar upper surface.

In addition, an extreme spring-loaded detent 38*b* is mountably positioned within the uppermost channel 28*a* at an extreme end thereof opposite the top 44, whereupon subsequent slidable engagement of the table top 20 to a farthest extended position results in frictional engagement of the flexible release/catch element 36 with the extreme spring-loaded detent 38*b*, thus providing an extensive surface area for easily accommodating laptop computers 120, projectors 122, and other relevant associated components.

The lower surface 42 of the table bottom 22 is comprised of a floor 49 circumscribed by walls 51 which form a generally rectangular, accessory insert receiving cavity 50. A plurality of generally, rectangularly-shaped cavities 55 are molded in a recessed manner during manufacturing process necessitated for providing an aesthetically pleasing planarly symmetrical appearance to the portable, compact computer and projector stand 10. The cavities 55 are adjacently arranged in two longitudinal rows 52, wherein each row 52 is comprised of four cavities 55. An upper surface 54 of each cavity 55 lies in a same plane formed by the floor 49. The cavities 55 also serve to provide additional storage space.

Figure 6:
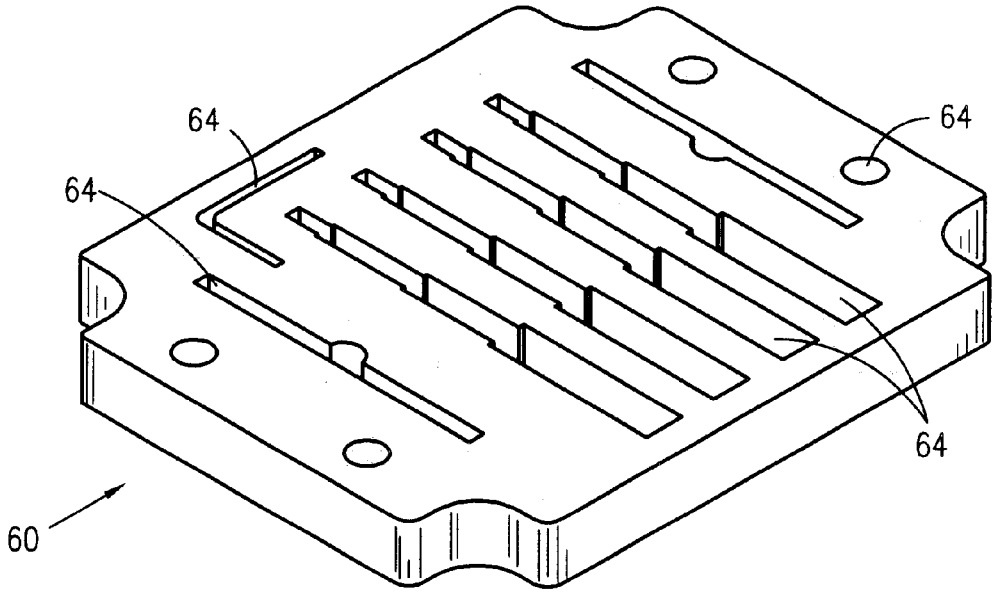
FIG. 6 is a perspective view of the top side of the foam insert according to the preferred embodiment of the present invention.
Figure 7:
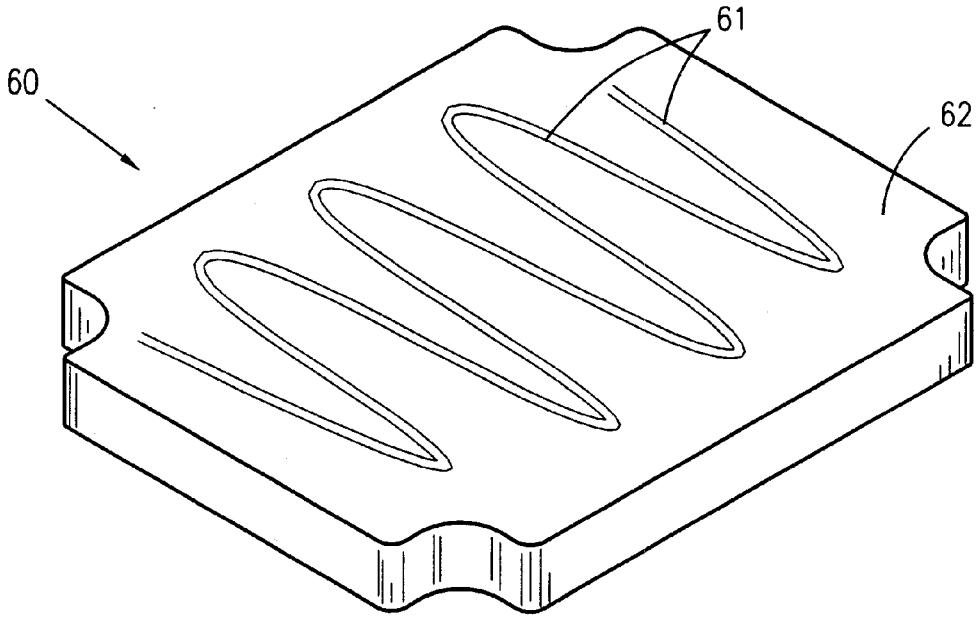
FIG. 7 is a perspective view of a bottom side of the foam insert according to the preferred embodiment of the present invention.
Figure 8:
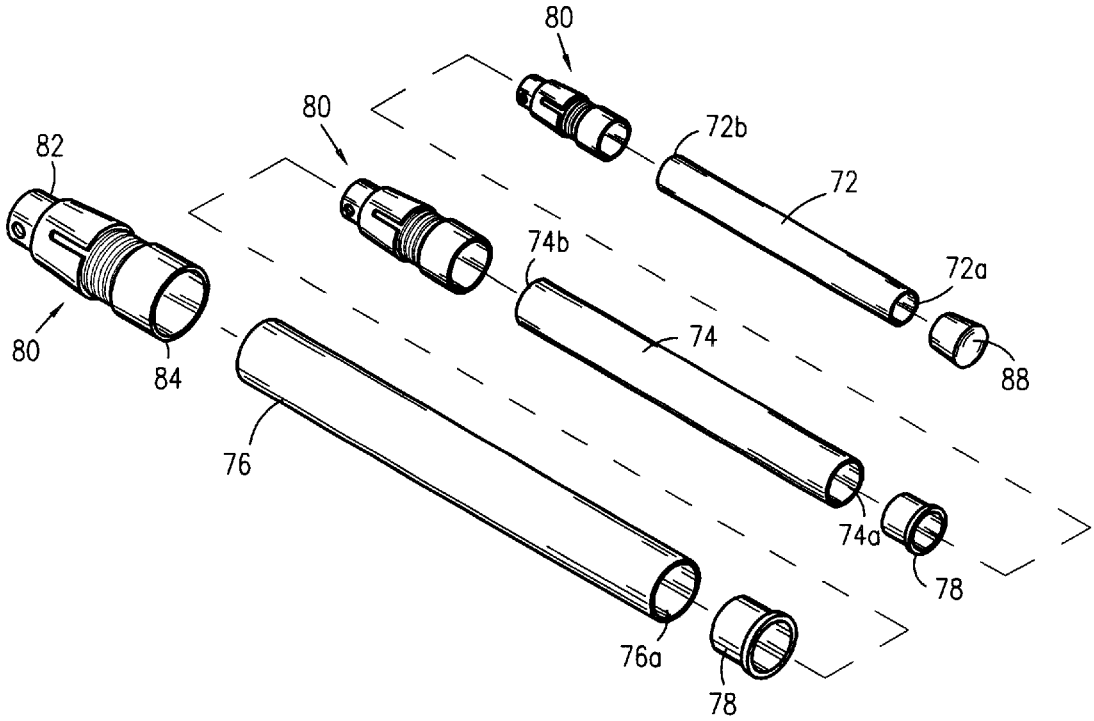
FIG. 8 is an exploded perspective view of the telescoping legs according to the preferred embodiment of the present invention.
Figure 9:
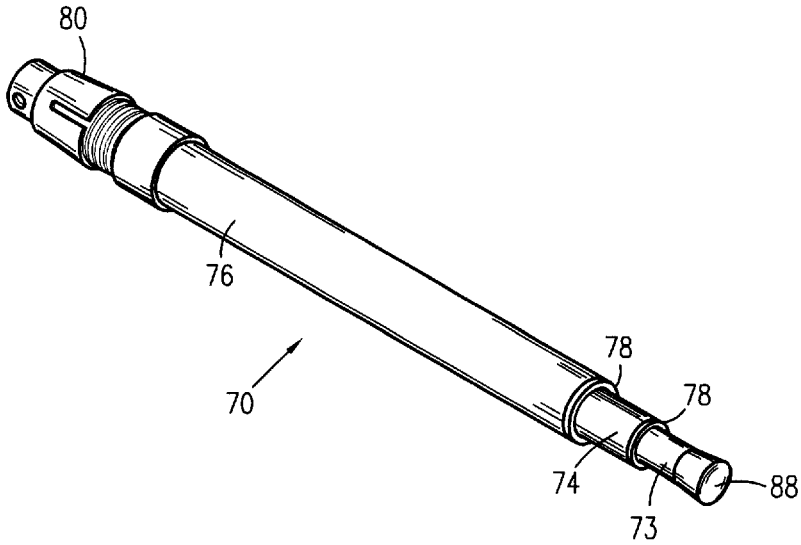
FIG. 9 is a perspective view of an assembled telescoping leg according to the preferred embodiment of the present invention.
Figure 10:
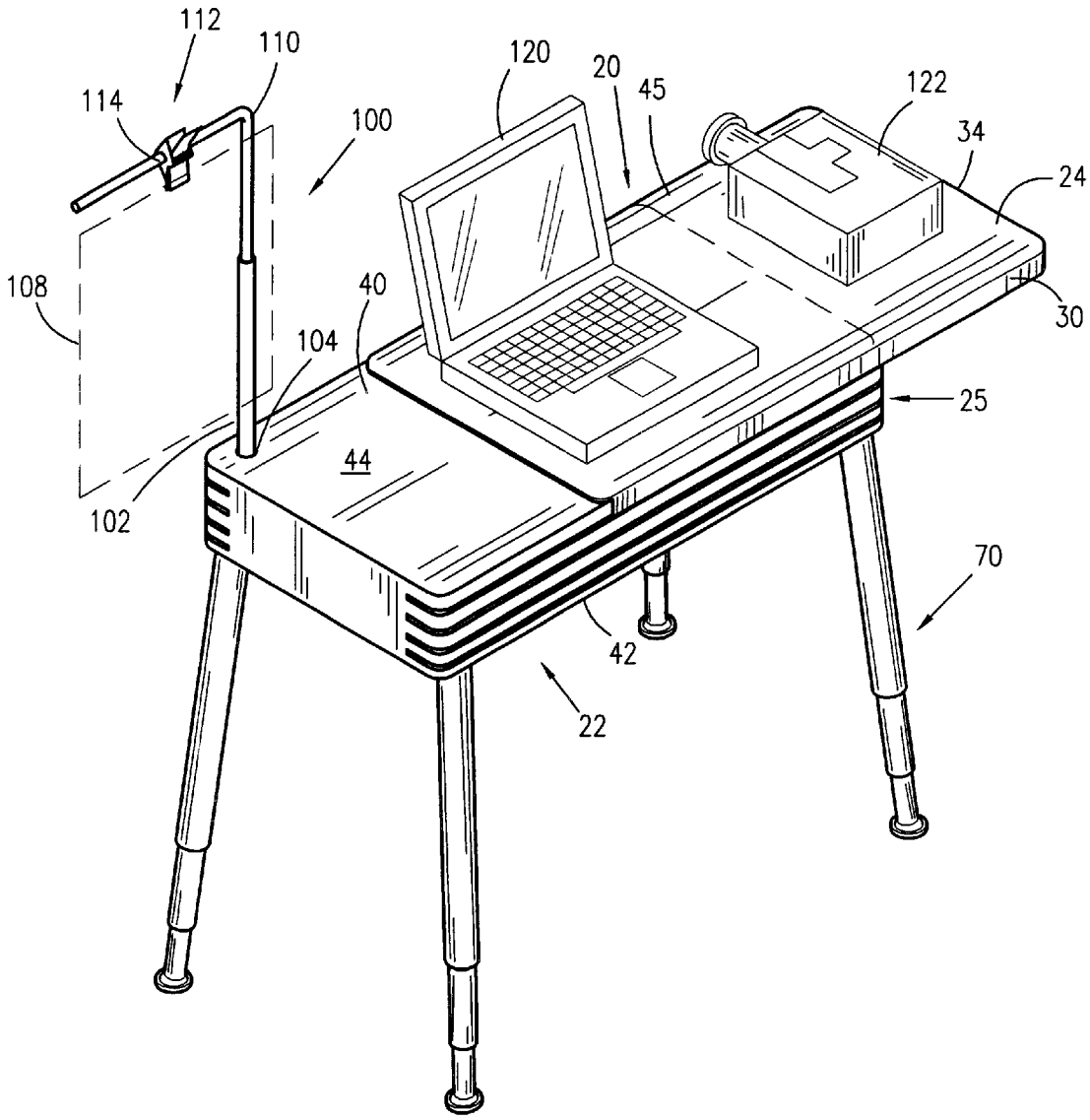
FIG. 10 is a perspective view of the present invention shown supporting a laptop computer and a projector, according to the preferred embodiment of the present invention.

Referring now to FIGS. 6 and 7, a medium density, closed cell foam insert 60 is provided and is dimensionally-shaped so as to correspondingly rest in a fitting and snug manner within the accessory insert receiving cavity 50. The foam insert 60 is die cut having a suitable adhesive 61 adhered to an underside 62 thereof, wherein the adhesive 61 is of a type which both assures engagement of the underside 62 of the foam insert 60 with the floor 49 of the table bottom 22, and allows for its removal and replacement within the accessory insert receiving cavity 50. The foam insert 60 includes a plurality of accessory-shaped cutouts 64 designed in various shapes for removably receiving telescoping legs 70 (to be described in greater detail below) and associated components. The design and dimensional shape of each accessory-shaped cutout 64 correlates with a particular telescoping leg 70 or accessory, thus each accessory-shaped cutout 64 is adapted so as to conform therearound and provides a storage volume therefor.

Referring now to FIGS. 1, 5, 8 and 9, a plurality of hollow, telescoping legs 70 are provided wherein each leg 70 comprises a lower member 72 telescoping within a medial member 74, and an upper member 76 having the medial member 74 telescoping therein. The telescoping legs 70 are constructed of a lightweight metal material such as aluminum. The upper member 76 is of a diameter measuring slightly larger than a diameter of the medial member 74, and the medial member 74 is of a diameter measuring slightly larger than a diameter of the lower member 72. The upper member 76 and the medial member 74 include a plastic sleeve 78 for being slidably received within an end 76*a*, 74*a* of the upper member 76 and medial member 74, respectively, wherein the plastic sleeve 78 is designed and configured so as to accommodate a forward end 82 of a plastic collet 80. A rearward end 84 of the plastic collet 80 is insertably received within an end 74*b*, 72*b* of the medial member 74 and lower member 72, respectively, opposite ends 74*a*, 72*b* respectively. Once the collet 80 is inserted within its respective plastic sleeve 78 and a desired leg 70 length has been chosen, a slight turn of the chosen member 72, 74 effectively secures such member 72, 74 within a respective member 74, 76. The use of the collet 80 provides for substantial integrity and stability of the portable, compact computer and projector stand during operation.

In order to removably attach assembled telescoping legs 70, the table bottom 22 is provided with a plurality of integrally molded pockets 90 positioned in corners of the floor 49 thereof for slidably receiving and securing a telescoping leg 70 therein. The rearward end 84 of the plastic collet 80 is insertably received within an end 76*b* of the upper member 76 opposite end 76*a*, and held therein via frictional interference. The forward end 82 of the collet 80 is slidably received within pocket 90, and a subsequent slight turning of the upper member 76 serves to effectively secure such member 76 within the pocket 90.

In order to remove the telescoping leg 70, the user simply turns the upper member 76 in an opposite direction of that which is stated hereinabove, thus allowing the telescoping leg 70 to be slidably removed from its respective pocket 90, and can subsequently be disassembled and placed within the foam insert 60 for storage. In order to prevent inadvertent movement by the present invention during use, a plurality of rubber feet 88 are provided, wherein each foot 88 is slidably received within an end 72*a* of each lower member 72 opposite of end 72*b* thereof, and is removably held therein through frictional interference.

Finally, a removably attachable, telescoping working document holder 100 is provided, shown in FIG. 1. The document holder 100 is of a linearly, elongated telescopic design comprising a pedestal 102 for being removably secured within an impingement void 104 formed along the primary top 44 of the upper surface 40 of the table bottom 22. The location of the impingement void 104 is intended merely as a suggestion and is in no way meant to be limiting.

The document holder 100 is further comprised of an easel portion 110 telescoping inside the pedestal 102 and is suitable for supporting notes, documents 108, sketches, and the like. The document 108 is envisioned as being held securely to the easel portion 110 via an attachment means 112, such as a paper clip or an alligator clip 114.

2. Operation of the Preferred Embodiment

To use the present invention, a user removes the telescoping legs from the foam insert. The user then slidably engages the plastic sleeves within an end of each upper member and medial member. The user next inserts a forward end of a plastic collet within each plastic sleeve. Next, the user slidably inserts a rearward end of the plastic collet within an opposite end of the medial member and lower member. Once the user has inserted each collet within its respective plastic sleeve and has chosen a desired leg length, the user slightly turns a chosen member for effectively securing such member within its respective member.

In order to removably attach assembled telescoping legs, the user insertably engages the rearward end of each plastic collet within an opposing end of each upper member, whereby the collet is held therein via frictional interference. The user then slidably inserts each forward end of each collet within a pocket of the table bottom, and slightly turns the upper member to effectively secure such member within the pocket. The user then slidably inserts rubber feet within a lower end of each lower member in order to prevent inadvertent movement by the present invention during use. Next, the user selectively adjusts a desired linear length of the table top by linearly engaging the table top along the track guide of the table bottom. Finally, the user removes the working document holder from storage within the foam insert and slidably inserts the document holder via its pedestal within the impingement void located along the primary top of the upper surface of the table bottom. The user removably secures a document to the easel via an alligator clip. The user removes additional components and accessories as needed from cavities within the table bottom and the foam insert. When the user has completed his use of the present invention, the user simply reverses the aforementioned steps.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A portable, compact computer and projector stand comprising:

a table top having a generally planar upper surface for supporting a laptop computer and a projector, said table top constructed of a rigid plastic material and having a table bottom receiving end opposite an enclosed end, and said table top having an L-shaped track receiving lip circumscribing a substantial portion of said upper surface of said table top and extending perpendicularly downward a table bottom having a generally planar upper surface, said table bottom constructed of a rigid plastic material and having an upper surface opposite a lower surface, wherein said upper surface is of a split-level design which includes a primary top and a secondary top, said secondary top coextensive with said table top;

a closed cell foam insert, said closed cell foam insert being of medium density and die cut with a suitable adhesive adhered to an underside of said table bottom;

a plurality of telescoping legs, said plurality of telescoping legs being of a hollow configuration constructed of a lightweight metal material; and a working document holder, said working document holder being of a linearly, elongated telescopic design comprising an easel portion telescoping within a pedestal, said working document holder being suitable for supporting documents, wherein said documents being held securely to said easel portion via an attachment means.

2. The portable, compact computer and projector stand of claim 1, wherein said table bottom includes a plurality of linearly elongated, horizontal channels integrally formed along opposite sides of said table bottom, and wherein said plurality of linearly elongated channels comprise an uppermost channel serving as a track guide for slidably receiving said L-shaped track receiving lip of said table top.

3. The portable, compact computer and projector stand of claim 2, wherein said uppermost channel having a plurality of spring-loaded detents aligned at spaced locations along a linear length within said uppermost channel.

4. The portable, compact computer and projector stand of claim 3, wherein said uppermost channel further comprising a proximal spring-loaded detent mountably positioned within said uppermost channel in such a manner and location so as to provide a flat planar upper surface upon flush engagement by said table bottom receiving end with said primary top of said table bottom.

5. The portable, compact computer and projector stand of claim 1, wherein said lower surface of said table bottom comprising a floor circumscribed by walls forming an accessory insert receiving cavity of a generally rectangular configuration.

6. The portable, compact computer and projector stand of claim 3, wherein said lower surface includes a plurality of integrally molded pockets positioned in corners of said floor, wherein each of said plurality of integrally molded pockets is designed and configured for slidably receiving and securing each of said plurality of telescoping legs.

7. The portable, compact computer and projector stand of claim 2, wherein said table top having a flexible release/catch element molded integral to said upper surface of said table top, and wherein said flexible release/catch element comprising a protruding catch projection for frictionally engaging each of said plurality of spring-loaded detents upon linear engagement of said L-shaped track receiving lip within said uppermost channel, thereby providing selective linear adjustment of said table top, and wherein said flexible release/catch element can be pulled in a direction away from said table top so as to remove mechanical interference between said plurality of spring-loaded detents and said protruding catch projection, and whereupon subsequent release of said flexible release/catch element allows for frictional engagement of said protruding catch projection with nearest of said plurality of spring-loaded detents.

8. The portable, compact computer and projector stand of claim 7, wherein said uppermost channel further comprising an extreme spring-loaded detent mountably positioned within said uppermost channel at an extreme end of said uppermost channel opposite said top, whereupon subsequent slidable engagement of said table top to a farthest extended position provides an extensive surface area for easily accommodating said laptop computers and said projectors.

9. The portable, compact computer and projector stand of claim 1, wherein said closed cell foam insert is dimensionally-shaped so as to correspondingly rest in a fitting and snug manner within said accessory insert receiving cavity.

10. The portable, compact computer and projector stand of claim 9, wherein said closed cell foam insert includes a plurality of accessory-shaped cutouts designed in various shapes for removably receiving said plurality of telescoping legs and associated components.

11. The portable, compact computer and projector stand of claim 10, wherein each of said plurality of accessory-shaped cutouts is adapted so as to provide a storage volume for said plurality of telescoping legs and said associated components.

12. The portable, compact computer and projector stand of claim 11, wherein each of said plurality of telescoping legs being constructed of aluminum and comprising a lower member telescoping within a medial member, and an upper member having said medial member telescoping within said upper member.

13. The portable, compact computer and projector stand of claim 12, wherein said upper member and said medial member include a plastic sleeve for being slidably received within an end of said upper member and an end of said medial member, and wherein said plastic sleeve is designed and configured so as to accommodate a forward end of a plastic collet.

14. The portable, compact computer and projector stand of claim 13, wherein said plastic collet having a rearward end for being insertably received within an opposite end of said medial member and said lower member for effectively securing said lower member with said medial member, and said medial member within said upper member, thus providing for substantial integrity and stability of said portable, compact computer and projector stand during operation.

15. The portable, compact computer and projector stand of claim 13, wherein said forward end of said plastic collet is slidably received and turned within each of said plurality of integrally molded pockets for effectively securing said upper member within each of said plurality of integrally molded pockets.

16. The portable, compact computer and projector stand of claim 12, wherein said plurality of telescoping legs further comprise a plurality of rubber feet for preventing inadvertent movement by said portable, compact computer and projector stand during use, wherein each of said plurality of rubber feet is slidably received within a lower end of said lower member, and is removably held within said lower end through frictional interference.

17. The portable, compact computer and projector stand of claim 1, wherein said pedestal is removably secured within an impingement void formed along said upper surface of said table bottom, and wherein said attachment means is an alligator clip.

* * * * *